US006191373B1

(12) United States Patent
Liao

(10) Patent No.: US 6,191,373 B1
(45) Date of Patent: Feb. 20, 2001

(54) DIAL PROGRAMMING SWITCH

(76) Inventor: Sheng-Hsin Liao, No. 10, Alley 38, Lane 229, San Chun St., Shu Lin, Taipei Hsien (TW)

( * ) Notice: Under 35 U.S.C. 154(b), the term of this patent shall be extended for 0 days.

(21) Appl. No.: 09/426,884

(22) Filed: Oct. 26, 1999

(51) Int. Cl.[7] ..... H01H 15/02

(52) U.S. Cl. ..... 200/16 A; 200/16 R; 200/551; 200/284

(58) Field of Search ..... 200/16 R–16 D, 200/18, 547, 548–551, 284

(56) References Cited

U.S. PATENT DOCUMENTS

| | | | | |
|---|---|---|---|---|
| 3,917,921 | * | 11/1975 | Jakubauskas | 200/333 |
| 4,075,442 | * | 2/1978 | Fukuda et al. | 200/16 F |
| 4,366,351 | * | 12/1982 | Ditzig | 200/16 R |
| 4,539,446 | * | 9/1985 | Raab et al. | 200/16 R |
| 4,590,344 | * | 5/1986 | Kikta et al. | 200/291 |
| 4,658,101 | * | 4/1987 | Akimoto et al. | 200/16 R |
| 4,841,109 | * | 6/1989 | Sakakino et al. | 200/302.1 |
| 5,967,302 | * | 10/1999 | Lin | 200/550 |
| 5,994,654 | * | 11/1999 | Benson | 200/283 |

* cited by examiner

*Primary Examiner*—Michael Friedhofer
(74) *Attorney, Agent, or Firm*—Rosenberg, Klein & Lee

(57) ABSTRACT

A dial programming switch comprises, especially, a switch structure which can be connected to the bank pin connector, comprises a seat, an upper cover, a plurality of push buttons and terminal. The seat spaced with a plurality of receiving grooves, each groove is connected with two terminal receiving holes at the lower side thereof. The upper cover is spaced with a plurality of holes with respect to the receiving grooves on the seat, the upper cover covering on the top of the seat. A plurality of push buttons each having a push button seat. The top of the push button seat is installed with a protrusion which protrudes from the holes of the upper cover. The bottom of the push button seat has a convex pushing portion. The push buttons are matched with the push button seat on the receiving grooves of the seat. A plurality of terminal sets each including a first terminal and a second terminal. The first terminal and second terminal are fixed to the terminal receiving hole of the seat. Each of the first terminal and second terminal extending with two clamping portions. The upper ends of the first terminal and second terminal each extending with a contact portion. The contact portion of the first terminal is formed as a convex portion; and the contact portions of the first terminal and the second terminal are installed on the receiving grooves of the seat; the contact portion of the second terminal is formed below the contact portion of the first terminal. The pushing portion of the push button ejecting against the contacting portion of the first terminal. Therefore, an easily assembled and low manufacturing cost dial programming switch is formed by aforesaid structure.

1 Claim, 7 Drawing Sheets

DIAL PROGRAMMING SWITCH

BACKGROUND OF THE INVENTION

1. Field of the Invention

The present invention relates a dial programming switch comprises, especially, a switch structure which can be connected to a pin bank connector, and manufactured easily. Thus, the cost is reduced greatly.

2. Description of the Prior Art

The prior art dial programming switch includes a seat, an upper cover, a plurality of push button, and terminal sets. The terminal sets include a first terminal and a second terminal. Furthermore, a conductive terminal is installed on the push button. By the pushing of the push button, the conductive terminal may selectively control the conduction of the first terminal and second terminal for determining the ON and OFF states of a switch. Such kinds of patent can refer to Taiwan Patent Publication Nos. 291180, 311730, 308350, etc.

However, in the prior art dial programming switch, each push button needs to assemble with a conductive terminal with much working time and hours. Thus the manufacturing process is complex so that the cost is high. Moreover, the prior art dial programming switch has terminal sets which are connected with other objects by welding. Thus, the use thereof is very inconvenient.

SUMMARY OF THE INVENTION

Accordingly, the primary object of present invention is to provide a dial programming switch comprises, especially, a switch structure which can be connected to the pin bank connector, comprises a seat, an upper cover, a plurality of push buttons and terminals. In the present invention, by the integrally formed first contact portion of the first terminal and the convex portion to move upwards and downwards. The contact between the first contact portion of the first terminal and the second contact portion of the second terminal is controlled so as to select the switch to be in an OFF or ON state. The first terminal, second terminal, and convex portion are integrally formed. It can be manufactured easily. Thus, the cost is reduced greatly. The conductive terminal assembled in a push button for controlling the conduction of the first terminal and the second terminal as that in the prior art technology need not be used in the present invention.

The various objects and advantages of the present invention will be more readily understood from the following detailed description when read in conjunction with the appended drawing.

DESCRIPTION OF THE PREFERRED EMBODIMENT

Figure 1:
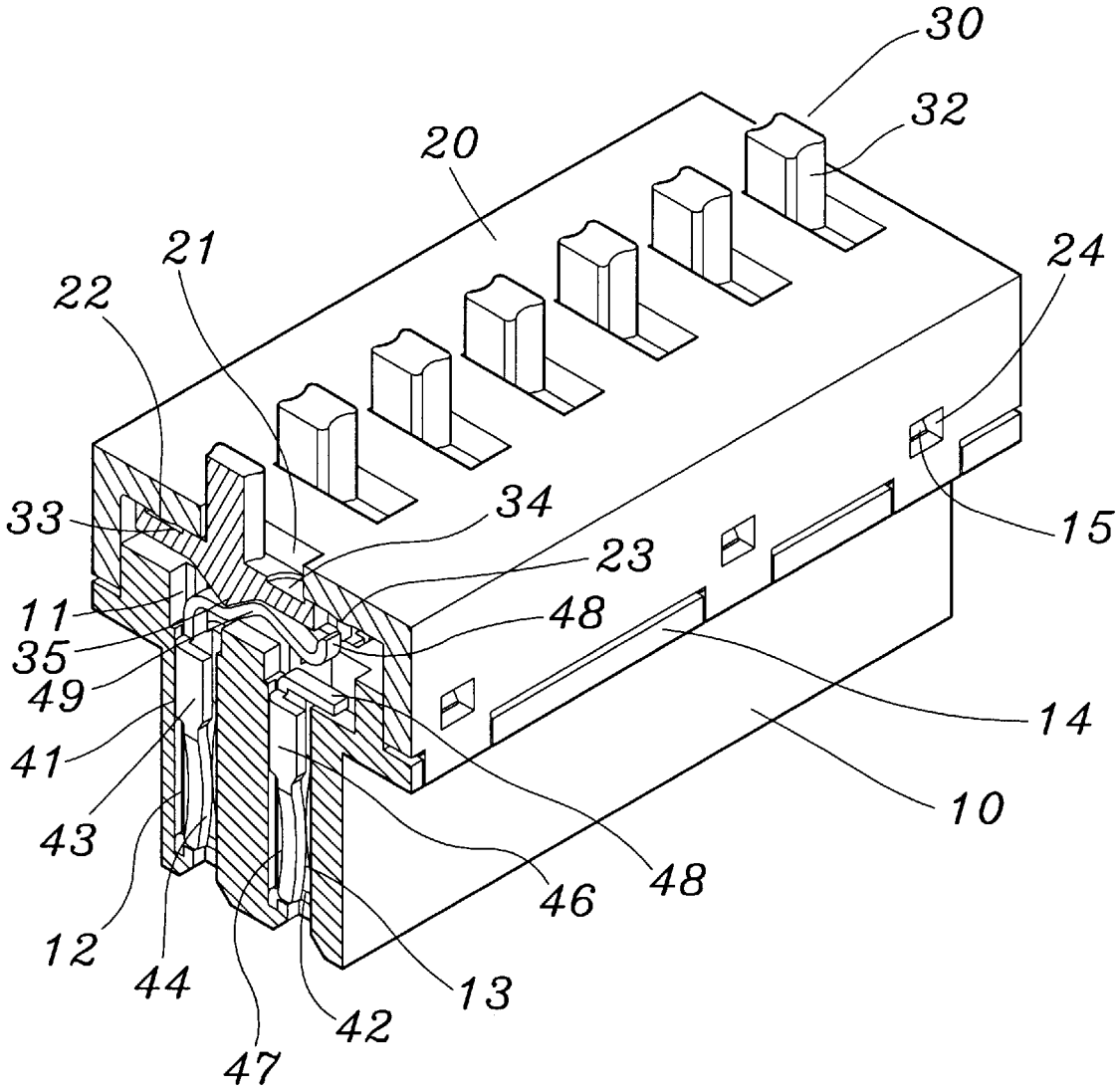
FIG. 1 is a perspective view of the present invention.
Figure 2:
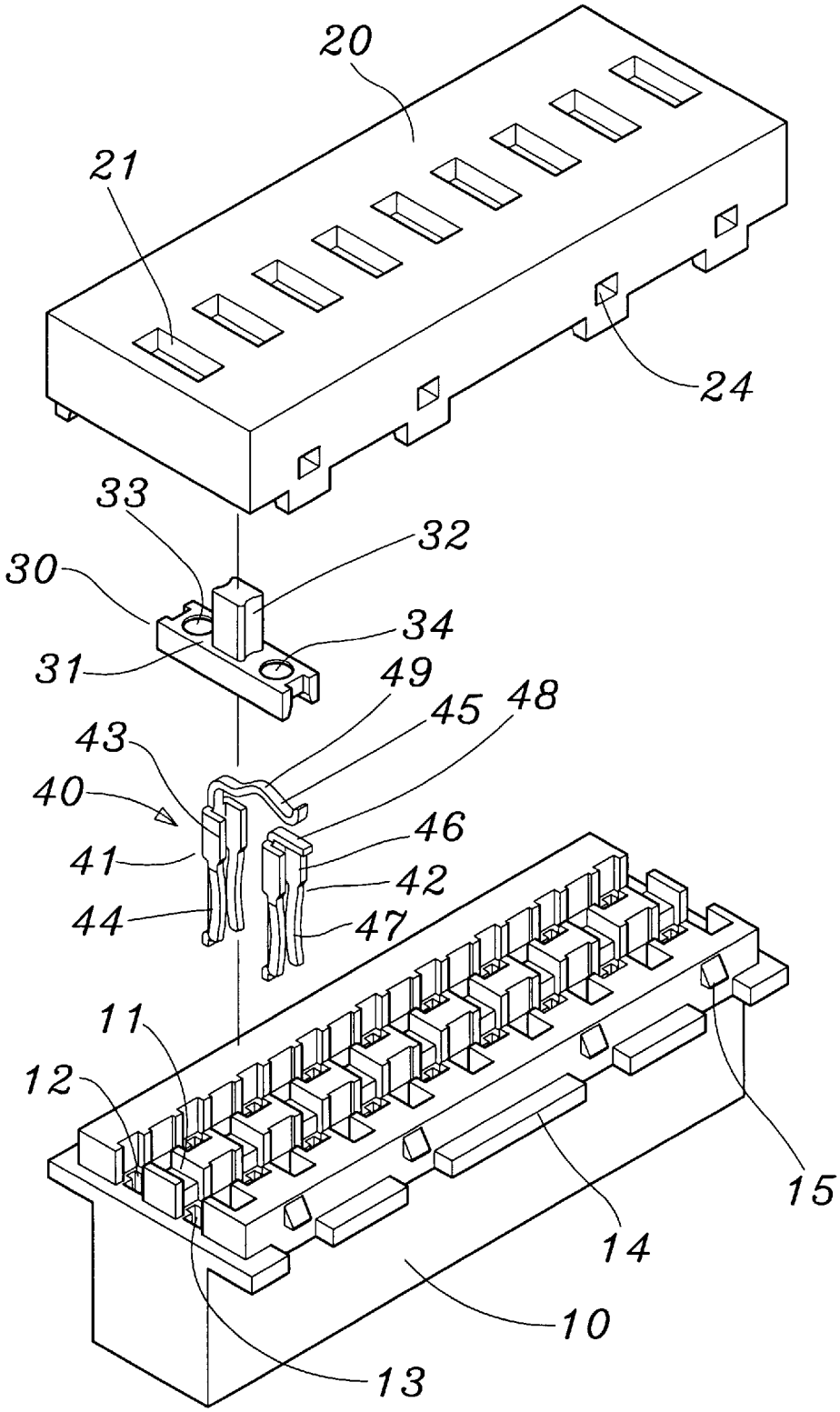
FIG. 2 is an exploded perspective view of the present invention.
Figure 3:
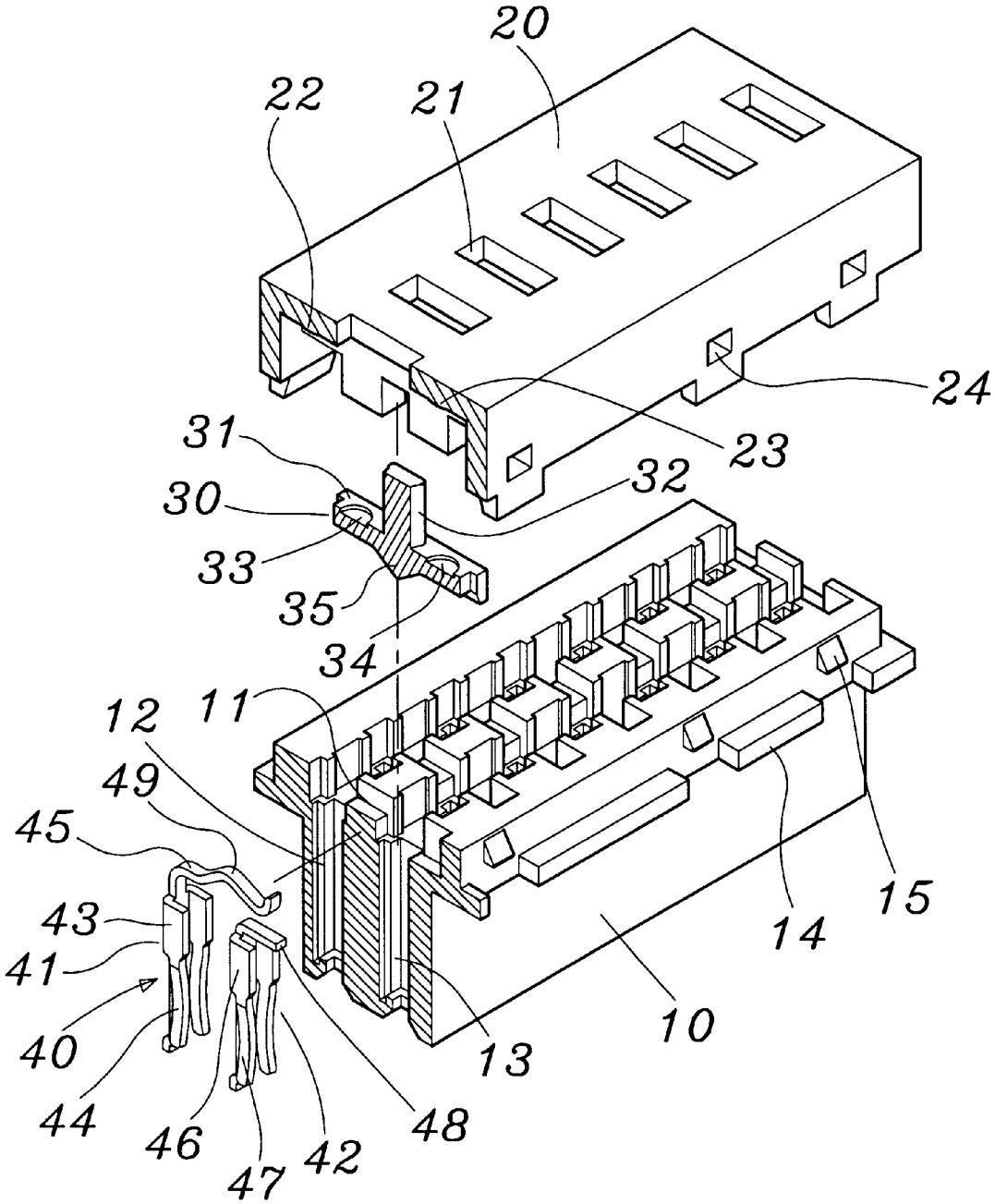
FIG. 3 is a cross sectional perspective view of the present invention.

With reference to FIGS. 1, 2, and 3, the dial programming switch of the present invention is illustrated. The dial programming switch of the present invention includes a seat 10, an upper cover 20, a plurality of push buttons, and terminal sets 40. The seat 10 is made of plastics or other insulated material. A plurality of receiving grooves 11 are spaced arranged in the longitudinal direction of the seat 10. The lower portion of each receiving groove 11 is connected with a first terminal receiving hole 12 and a second terminal receiving hole 13. The upper ends of these two terminal receiving holes 11 and 12 pass through the receiving grooves 11. The lower ends thereof pass through the bottom of the seat 10. The four sides of the seat 10 are installed wit a plurality of flanges 14 near the top portion thereof for bearing the upper cover 20 to cover on the seat 10. At least two sides of the seat 10 (front side and back side) are protruded with a plurality of buckling bodies 15 near the top end thereof for buckling the upper cover 20.

The upper cover 20 serves to cover the top end of the seat 10. The upper cover 20 is installed with a plurality of holes 21 along the longitudinal direction thereof. The holes 21 are at positions with respect to the receiving grooves 11 of the seat 10 for receiving the protrusion 32 of each push button 30. The bottom of the upper cover 20 has positioning spots 22 and 23 at two sides of each hole 21, one for each side, for positioning the push button 30. At least two sides (front and back sides) of the upper cover 20 are installed with a plurality of buckling holes 24 for buckling with the seat 10.

Each push button 30 has a push button seat 31. The middle portion at the top of the push button seat 31 has a protrusion 32. The top of the push button seat 31 has positioning grooves 33 and 34 at two sides of the protrusion 32, one for each side, with respect to the positioning spots 22 and 23. A protruding push portion 35 is installed at the middle part at the bottom of the push button seat 31. The push button 31 is located above the receiving groove 11 of the seat 10 by the push button seat 10. The push button 30 can move forwards and backwards above the receiving groove 11. Furthermore, by the matching of the positioning grooves 33 and 34 of the push button 30 and the positioning spots 22 and 23 of the upper cover 20, an elastic stage in moving the push button 30 is formed.

Each terminal set 40 includes a first terminal 41 and a second terminal 42. The first terminal 41 and the second terminal 42 are made of conductive material. The first terminal 41 has a first body 43 with a U shape cross section. The first body 43 is fixed in a first terminal receiving hole 12 of the seat 10. Two sides of the lower end of the first body 43 are extended with two cambered clamping portions 44. The upper end of the first body 43 is connected to a first contact portion 45 extended horizontally. The middle portion of the first contact portion 45 slightly protrudes with a convex portion 49. The first contact portion 45 is installed in the receiving groove 11 of the seat 10. The second terminal 42 has a second body 46 with an approximately U shape cross section. The second body 46 is fixed in the second terminal receiving hole 13 of the seat 10. The two sides of the lower end of second body are extended with two cambered clamping portions 47. The upper end of the second body 46 has an approximately horizontal second contact portion 48 which is installed at the receiving groove 11 of the seat 10. The second contact portion 48 is positioned below the first contact portion 45 with a proper distance.

After the push button 30 and the terminal set 40 are assembled to the seat 10, the upper cover 20 can cover the upper end of the seat 10. The lower ends of the four sides of the upper cover 20 are located on the flange 14 at the four sides of the seat 10, and it can be buckled with the buckling hole 24 of the upper cover 20 by the buckling body 15 of the seat 10. Thereafter, supersonic wave welding serves to weld the contact surface therebetween and the protrusion 32 of each push button 30 protrudes from the groove 21 of the upper cover 20. The pushing portion 35 of the push button 30 ejects against the top of the first contact portion 45 of the first terminal 41. Thereby, a dial programming switch is formed.

Figure 4:
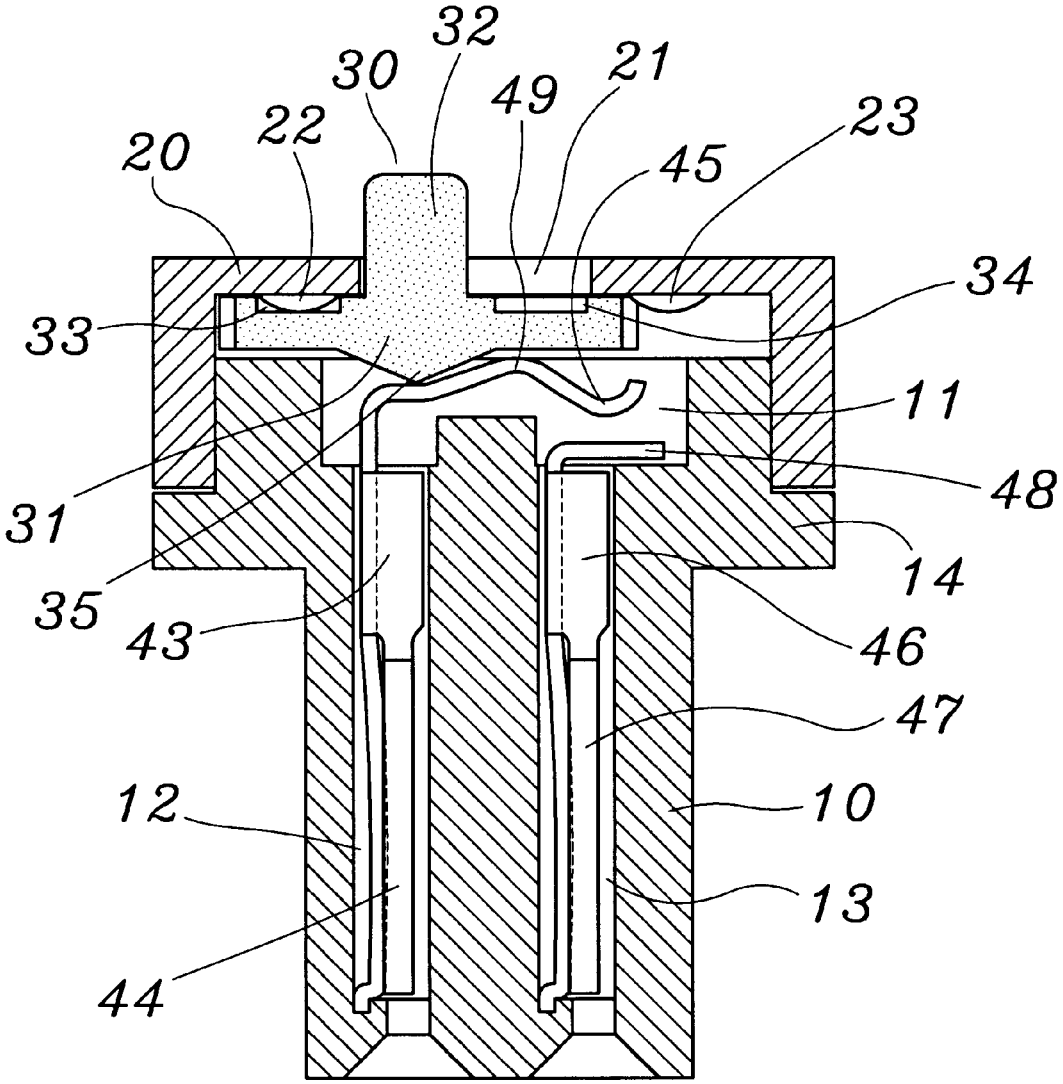
FIG. 4 is a schematic view showing the use of the present invention.
Figure 5:
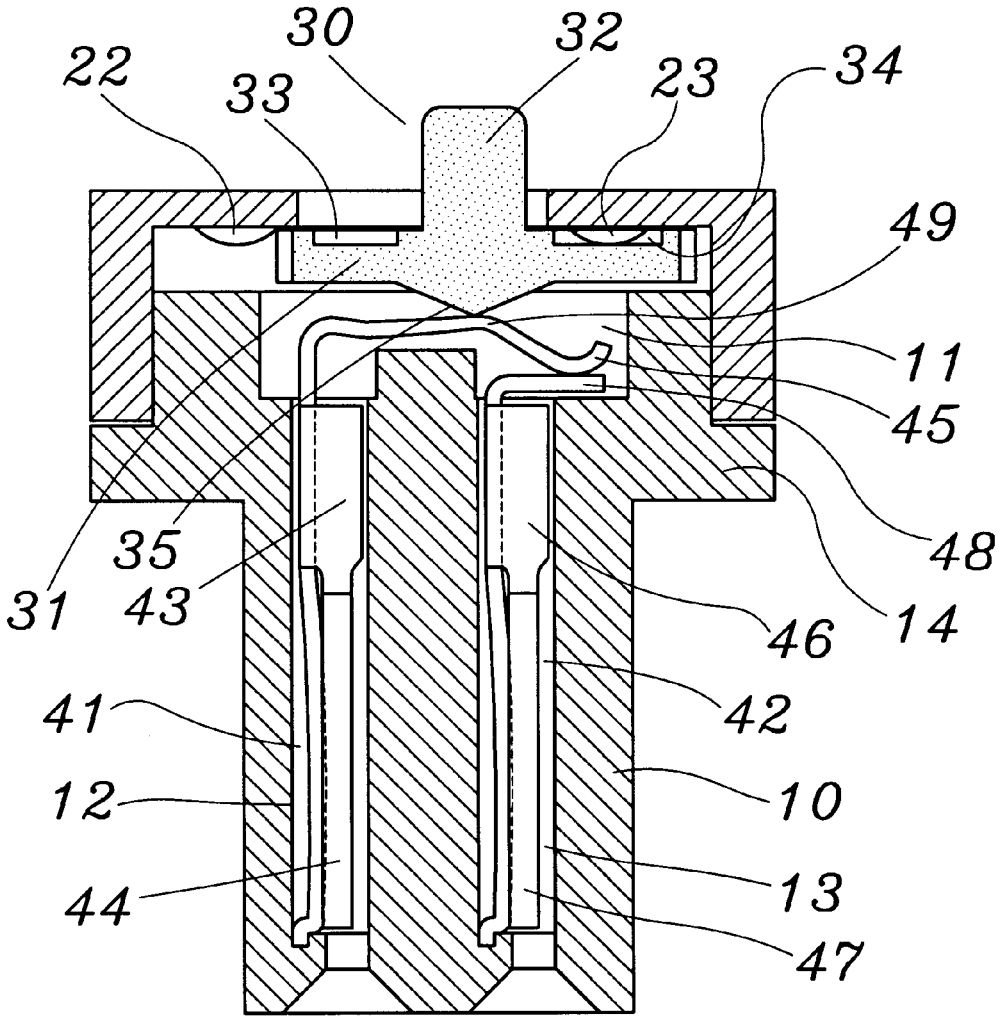
FIG. 5 is another schematic view showing the use of the present invention.

In the present invention, by moving the protrusion 32 of the push button 30, the push button 30 can be driven to be moved forwards and backwards above the receiving groove 11 of the seat 10. Thereby, by the pushing portion 35 at the bottom of the push button seat 31, it may selectively contact with the convex portion 49 of the first terminal 41. As shown in FIG. 4, as the push button 30 moves backwards, the pushing portion 35 of the push button 30 will separate from the convex portion 49 on the first contact portion 45 of the first terminal 41. The first contact portion 45 of the first terminal 41 will not contact with the second contact portion 48 of the second terminal 42. Now, the switch is off. As shown in FIG. 5, as the push button 30 moves forwards, the pushing portion 35 of the push button 30 will eject against the convex portion 49 on the first contact portion 45 of the first terminal 41 so as to push the first contact portion 45 to move downwards. Thus, the first contact portion 45 of the first terminal 41 will make contact with the second contact portion 48 of the second terminal 42. Then, the switch is on.

In the present invention, by the integrally formed first contact portion 45 of the first terminal 41 and the convex portion 49 to move upwards and downwards, the contact between the first contact portion 45 of the first terminal 41 and the second contact portion 48 of the second terminal 42 is controlled so as to select the switch to be in an OFF or ON state. The first terminal 41, second terminal 42, and convex portion 49 are integrally formed. It can be manufactured easily. Thus, the cost is reduced greatly. The conductive terminal assembled in a push button for controlling the conduction of the first terminal and the second terminal as that in the prior art technology need not be used in the present invention.

Figure 6:
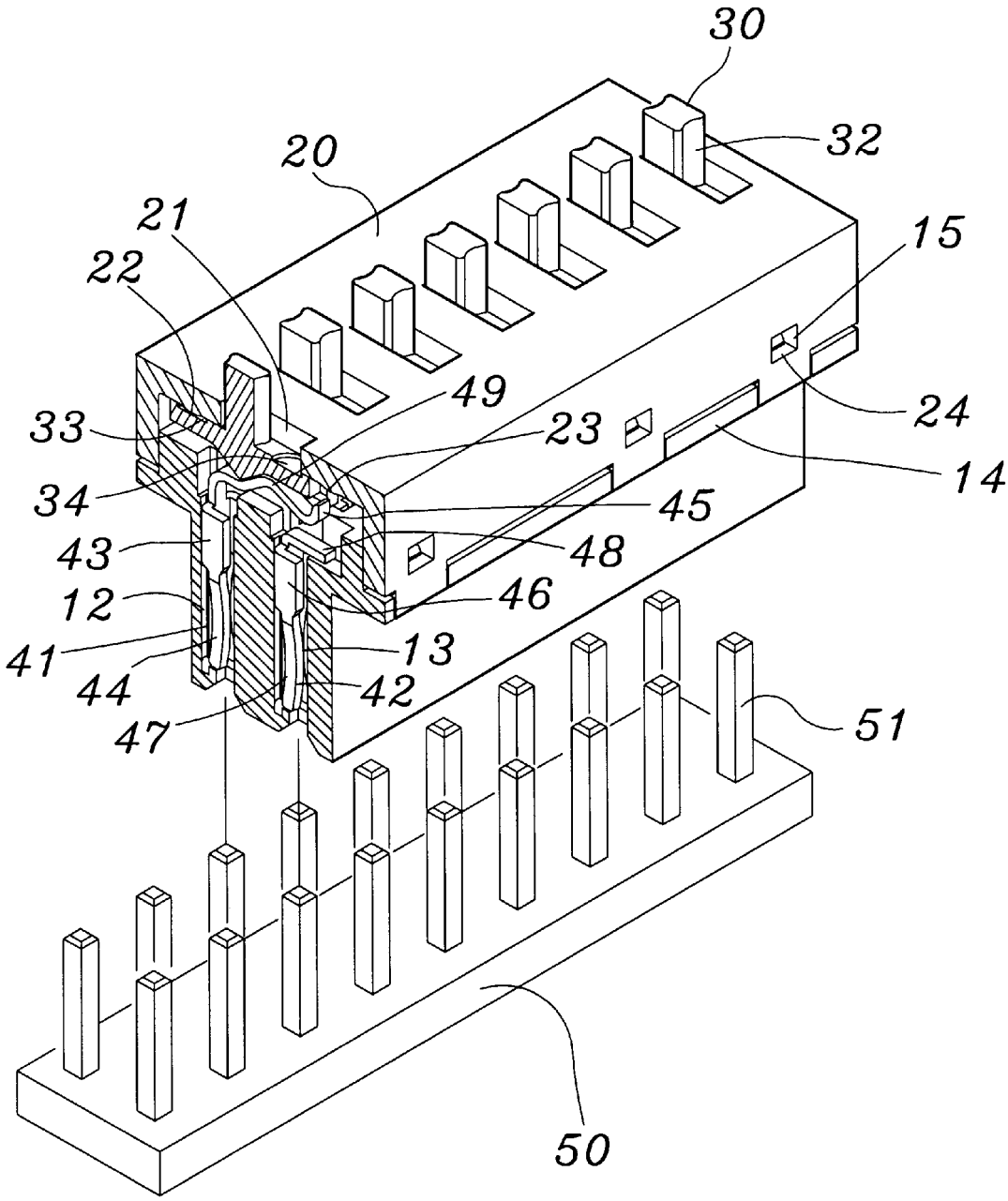
FIG. 6 is a perspective view showing the insertion state of the present invention.

Furthermore, as shown in FIG. 6, in the present invention, by the clamping portions 44 and 47 of the first terminal 41 and the second terminal 42 of the terminal set 40 to insert into the convex pin bank 51 of a correspondent connector 50 and other objects, the dial programming switch of the present invention has the function of the connection in pin bank connector.

Figure 7:
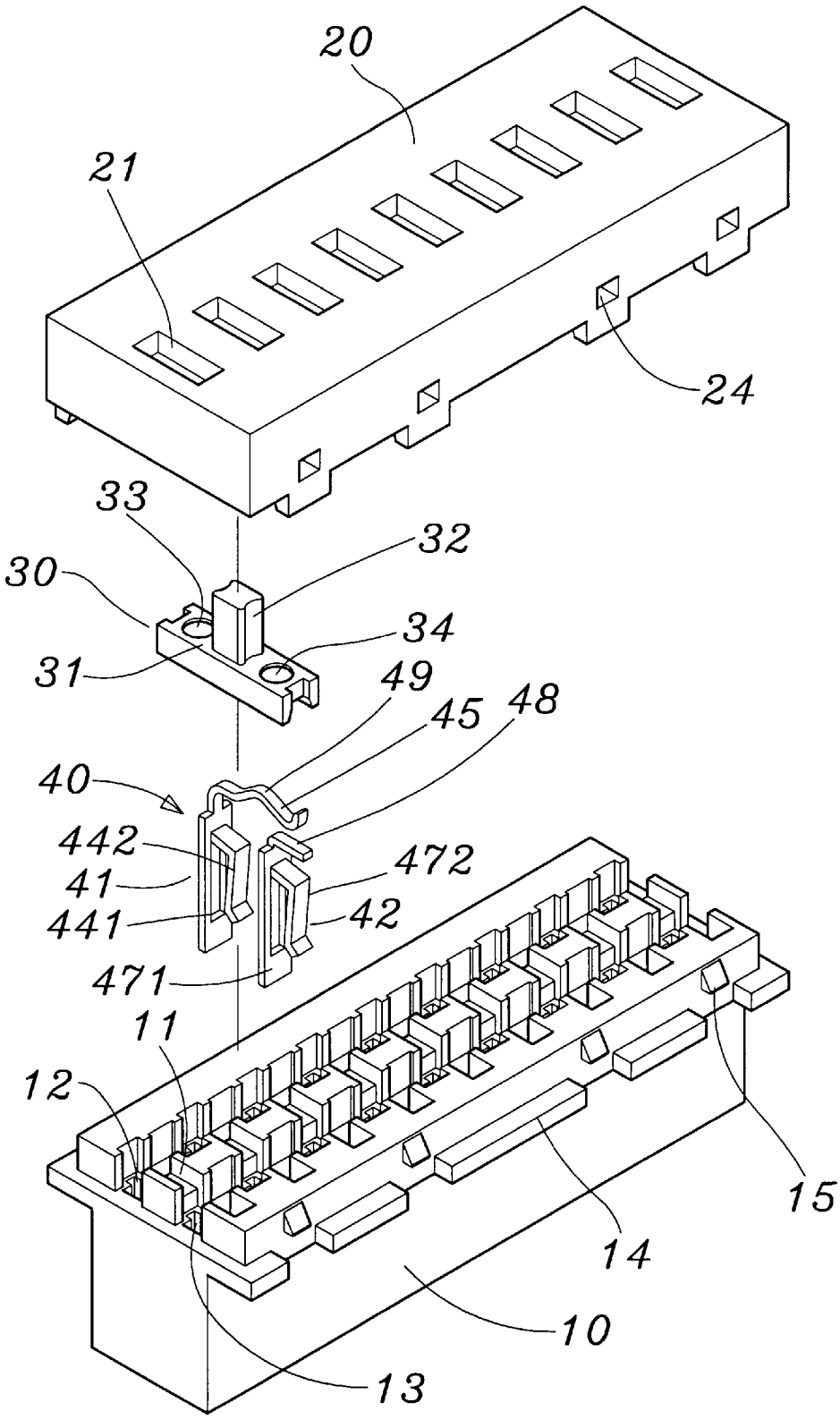
FIG. 7 is an exploded perspective view of another embodiment in the present invention.

Moreover, as shown in FIG. 7, in the present invention, the first terminal 41 may have a clamping portion 441. One side of the clamping portion 441 is extended with another clamping portion 442. The second terminal 42 has a clamping portion 471 which is fixed to the second terminal receiving hole 13 of the seat 10. One side of the clamping portion 471 is extended with another clamping portion 472. By the clamping portions 441, 442, 471, and 472 of the first terminal 41 and second terminal 42 of terminal set 40, the present invention may be inserted into the terminal of correspondent objects.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

We claim:

1. A dial programming switch comprising:

a switch seat having a plurality of longitudinally spaced receiving grooves, each of the plurality of receiving grooves being in open communication with two laterally spaced terminal receiving holes at a lower side thereof;

an upper cover having a plurality of longitudinally spaced holes disposed in respective aligned relationship with the plurality of receiving grooves in the switch seat, the upper cover being positioned on the switch seat to cover a top portion of the switch seat;

a plurality of push buttons each having a push button seat slidably disposed in a respective one of the plurality of receiving grooves, a top of each push button seat having a protrusion which protrudes from a respective one of the plurality of holes of the upper cover, a bottom of each push button seat having a convex pushing portion formed thereon; and, a plurality of terminal sets each including a first terminal and a second terminal, the first and second terminals of each of the plurality of terminal sets being fixed within a respective pair of the laterally spaced terminal receiving holes of the switch seat, each of the first terminals and second terminals having a lower portion with a U-shaped cross-sectional contour and being formed with two cambered clamping portions for engaging a respective pin of a connector, each of the second terminals having a contact portion formed on an upper end thereof and disposed in a respective one of the receiving grooves, each of the first terminals being formed with a laterally extending contact portion disposed in a respective one of the receiving grooves, each laterally extending contact portion having a distal end positioned above a contact portion of a corresponding second terminal and having an intermediately disposed convex portion, the pushing portion of each of the push buttons contacting a respective convex portion of a corresponding first terminal contact portion to displace the distal end thereof into contact with said contact portion of a corresponding second terminal responsive to a sliding displacement of a corresponding push button.

* * * * *